US007455447B2

(12) United States Patent
Jau

(10) Patent No.: US 7,455,447 B2
(45) Date of Patent: Nov. 25, 2008

(54) METHOD AND APPARATUS FOR A PORTABLE DEVICE

(75) Inventor: Tzi-Yu Jau, Taipei Hsien (TW)

(73) Assignee: Mediatek Inc., Hsin-Chu (TW)

( * ) Notice: Subject to any disclaimer, the term of this patent is extended or adjusted under 35 U.S.C. 154(b) by 130 days.

(21) Appl. No.: 11/536,981

(22) Filed: Sep. 29, 2006

(65) Prior Publication Data

US 2007/0268787 A1 Nov. 22, 2007

Related U.S. Application Data

(60) Provisional application No. 60/747,666, filed on May 19, 2006.

(51) Int. Cl.
*G04B 18/00* (2006.01)

(52) U.S. Cl. ..... 368/200

(58) Field of Classification Search ..... 368/10, 368/46, 156, 200–202
See application file for complete search history.

(56) References Cited

U.S. PATENT DOCUMENTS

| | | | | |
|---|---|---|---|---|
| 4,093,992 | A * | 6/1978 | Kawamura et al. | 708/111 |
| 4,250,523 | A * | 2/1981 | Murata | 368/82 |
| 5,740,129 | A * | 4/1998 | Frampton | 368/10 |
| 6,304,517 | B1 | 10/2001 | Ledfelt et al. | |
| 6,393,306 | B1 * | 5/2002 | Hobbi | 455/566 |
| 6,545,950 | B1 * | 4/2003 | Walukas et al. | 368/47 |
| 6,956,793 | B2 * | 10/2005 | Ngo | 368/156 |

* cited by examiner

*Primary Examiner*—Edwin A. Leon
*Assistant Examiner*—Thanh S Phan
(74) *Attorney, Agent, or Firm*—Thomas, Kayden, Horstemeyer & Risley

(57) ABSTRACT

A method for a portable device is disclosed. A reference clock is provided. A first time value and a first index are recording at a first time point. A second index is recorded at a second time point. The first time point and the second time point are counted according to the reference clock. The first index and the second index are calculated. A second time value is set according to the calculating result.

27 Claims, 5 Drawing Sheets

METHOD AND APPARATUS FOR A PORTABLE DEVICE

CROSS REFERENCE TO RELATED APPLICATIONS

This application claims the benefit of U.S. Provisional Application No. 60/747,666, filed May 19,2006.

BACKGROUND OF THE INVENTION

1. Field of the Invention

The invention relates to a correction method and device, and more particularly to a correction method and device for correcting a time value of a real time clock (RTC).

2. Description of the Related Art

FIG. 1 is a schematic diagram of a conventional device, which controls a real time clock (RTC). The device 100 controls a RTC 180 and comprises a crystal 110, a second counter 120, a minute counter 130, an hour counter 140, a day counter 150, a year counter 160, and a processor 170. Assume for the purposes of explanation that the frequency generated by the crystal 110 is 32768 Hz.

The second counter 120 counts pulses from the frequency generated by the crystal 110. When the accumulated count of the second counter 120 reaches 32768, the second counter 120 outputs a notification signal to the minute counter 130 for every 32768 pulses of the frequency. Thus, the accumulated count of the minute counter 130 is increased one unit from zero and the second counter 120 terminates a preceding count and begins a new count. When the accumulated count of the minute counter 130 reaches 60, the minute counter 130 outputs a notification signal to the hour counter 140. Thus, the accumulated count of the hour counter 140 is increased one unit from zero and the minute counter 130 terminates a preceding count and begins a new count.

When the accumulated counts of the hour counter 140 reaches 24, the hour counter 140 outputs a notification signal to the day counter 150. Thus, the accumulated count of the day counter 150 is increased one unit from zero and the hour counter 140 terminates a preceding count and begins a new count. When the accumulated counts of the day counter 150 reaches a preset value, the day counter 150 outputs a notification signal to the year counter 160. Thus, the accumulated count of the year counter 160 is increased one unit from zero and the day counter 150 terminates a preceding count and begins a new count.

When the accumulated count of the second counter 120, the minute counter 130, the hour counter 140, the day counter 150, or the year counter 160 is changed, the corresponding counter notices a processor 170 for updating time of a real time clock (RTC) 180.

Thus the accuracy of the RTC 180 is determined by the frequency generated by the crystal 110. The frequency generated by the crystal 110, however, is easily altered by two causes, temperature and frequency drift, thus, crystal 110 generates an incorrect frequency.

The frequency generated by the crystal 110 changes with environmental temperature. The frequency generated by the crystal 110 has a drift error between +20 ppm and −20 ppm due to manufacturing procedures. If the crystal 110 generates an incorrect frequency, the RTC 180 time is incorrect.

To solve the described problems, a conventional method corrects the accumulated count of the second counter 120. As shown in FIG. 2, the device 200 comprises a correction register 290 for correcting an RTC 280. A processor 270 updates the accumulated count of a second counter 220 according to the stored value of the correction register 290.

Although the RTC 280 can maintain a correct time by use of a conventional method, the correction register 290, and additional element, is required for storage of correct values. Thus, device cost is increased and the usable space is reduced.

BRIEF SUMMARY OF THE INVENTION

A method and apparatus for a portable device are provided. An exemplary embodiment of a method for a portable device is described in the following. A reference clock is provided. A first time value and a first index are recorded at a first time point. A second index is recorded at a second time point. The first time point and the second time point are counted according to the reference clock. The first index and the second index are calculated. A second time value is set according to the calculated result.

An exemplary embodiment of an apparatus for a portable device comprises a counter and a processing module. The counter counts and provides a first index and a second index according to a reference clock. The processing module records a first time value provided by a real time clock and the first index at a first time point and the second index at a second time point and calculates the first and second indexes such that the real time clock provides a second time value. The first time point and the second time point are counted according to the reference clock.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
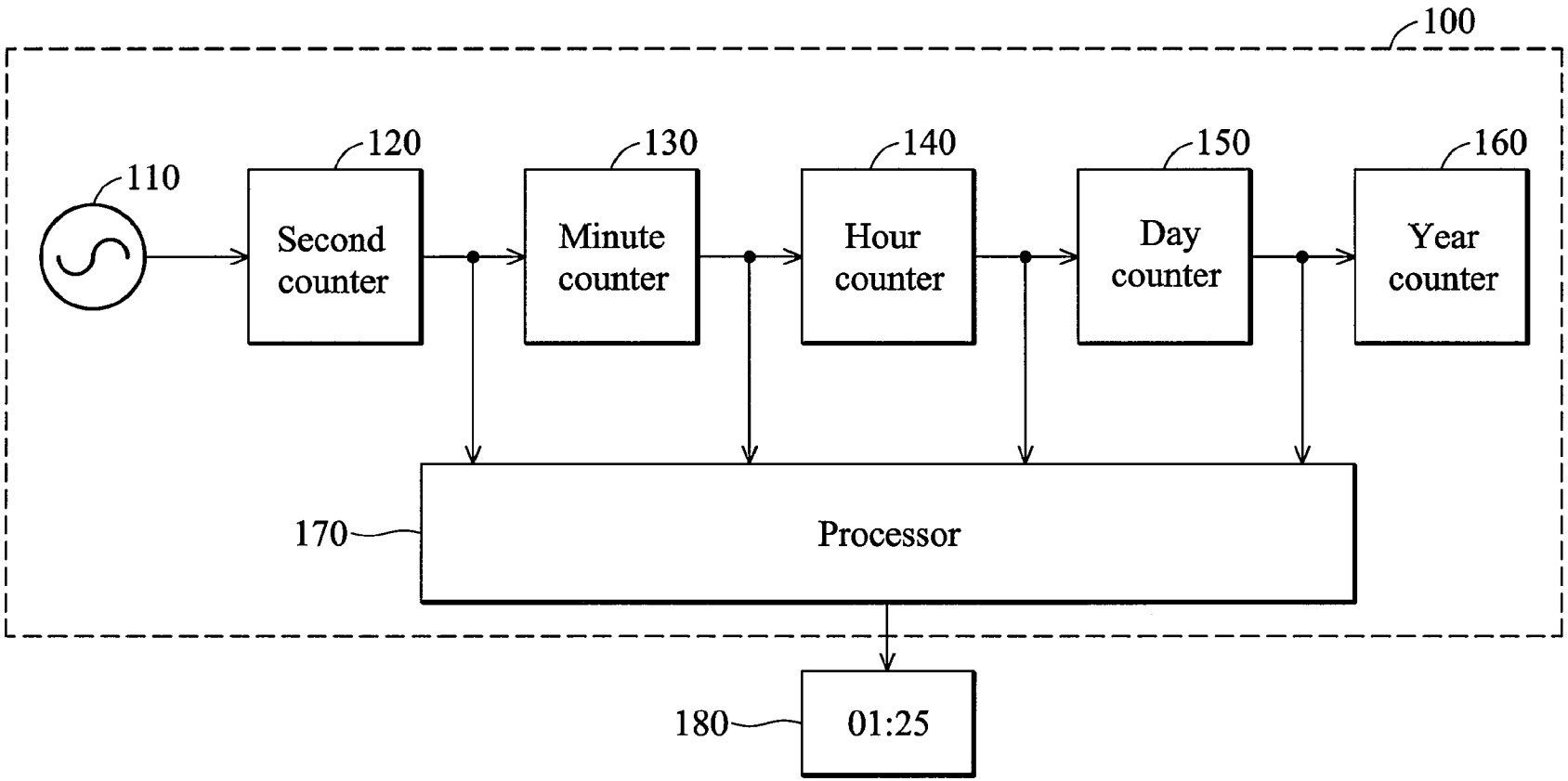
FIG. 1 (PRIOR ART)
FIG. 1 is a schematic diagram of a conventional device.
Figure 2:
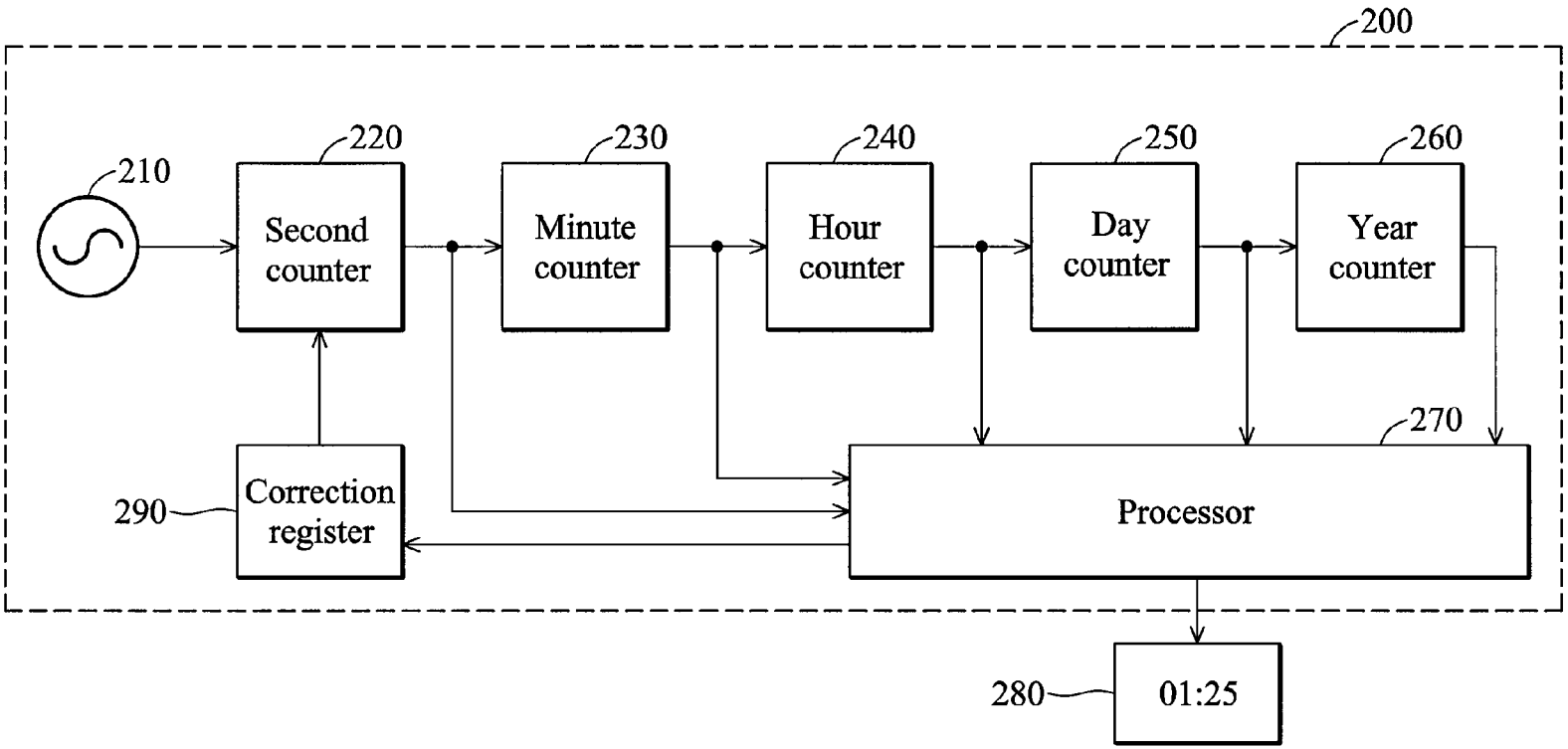
FIG. 2 (PRIOR ART)
FIG. 2 is a schematic diagram of another conventional device.
Figure 3:
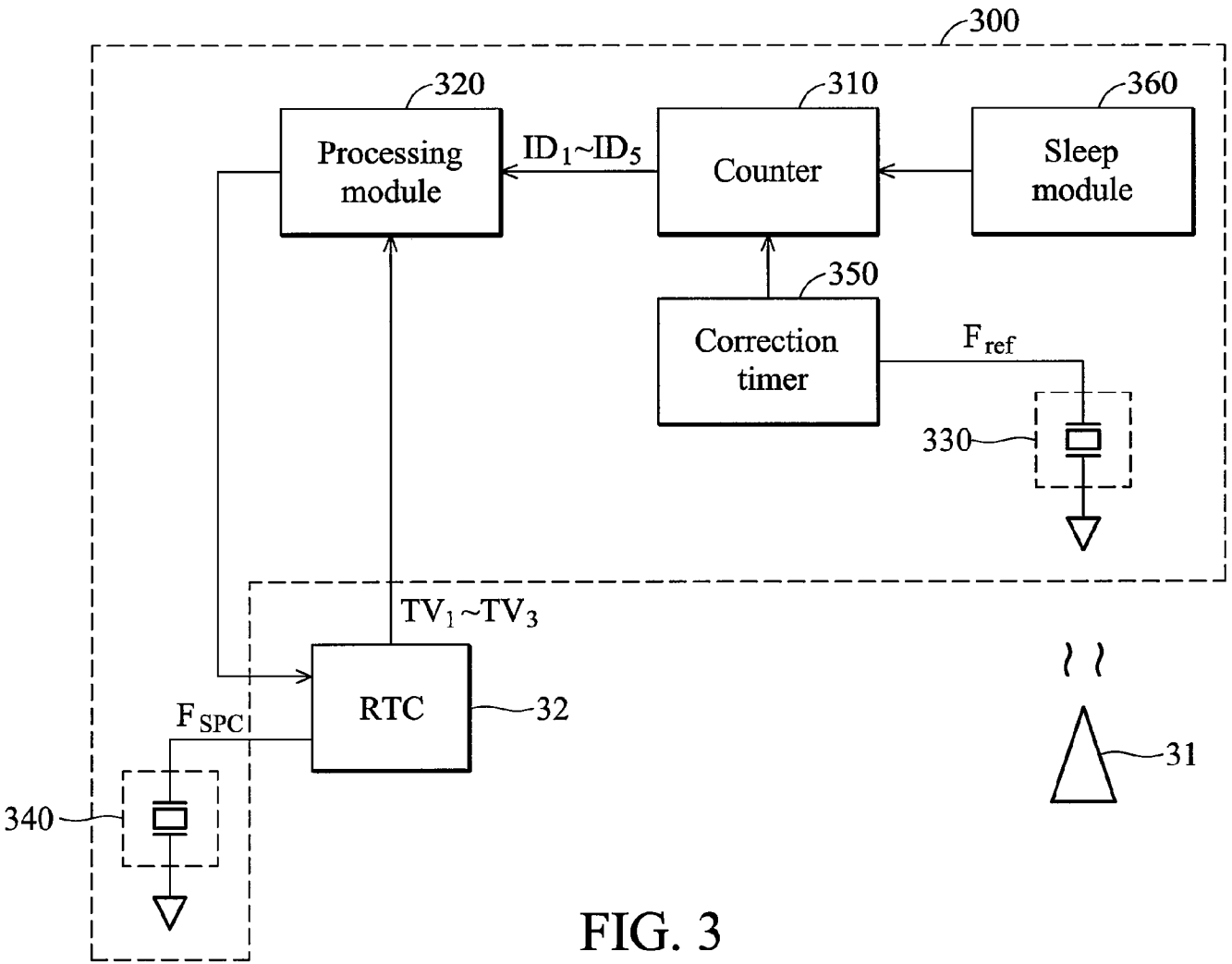
FIG. 3 is a schematic diagram of an exemplary embodiment of a device.

FIG. 3 is a schematic diagram of an exemplary embodiment of a device. The device 300 is applied to a portable device, such as a mobile phone. The device 300 comprises a counter 310, and a processing module 320. The counter 310 applied to debug counts pulses from a reference clock $F_{ref}$ and provides indexes $ID_1$~$ID_5$. A real time clock (RTC) 32 provides time values $TV_1$~$TV_3$.

At time point $T_1$, the processing module 320 records the time value $TV_1$ and the index $ID_1$. At time point $T_2$, the processing module 320 records the index $ID_2$ and calculates the indexes $ID_1$ and $ID_2$ such that the RTC 32 provides the time value $TV_2$. The time points $T_1$ and $T_2$ are counted according to the reference clock $F_{ref}$.

The device 300 further comprises frequency generators 330 and 340. The frequency generator 330 is a crystal for generating the reference clock $F_{ref}$. The frequency generator 340 generates a specific clock $F_{SPC}$. The RTC 32 provides time values $TV_1$ and $TV_3$ according to the specific clock $F_{SPC}$. In this embodiment, the frequency of the reference clock $F_{ref}$ is 13 MHz and that of the specific clock $F_{SPC}$ is 32 KHz.

The drift of the reference clock $F_{ref}$ is approximately less than ±10 ppm and that of a system clock, which generated by a base station 31, is less than ±0.05 ppm. The frequency of the reference clock $F_{ref}$ is equal to that of the system clock. In some embodiments, since the drift of the system clock is less than that of the reference clock $F_{ref}$, the system clock is utilized to correct the reference clock $F_{ref}$.

When the specific clock $F_{SPC}$ is wrong, the time value provided by the RTC 32 is also wrong. Thus, the processing module 320 updates the time value provided by the RTC 32 during a preset period.

For the purposes of description assume the time value provided by the RTC 32 is 01:35 and the processing module 320 updates the time value provided by the RTC 32 every hour. After one hour, the time value provided by the RTC 32 should be 02:25. The real time value provided by the RTC 32 is 02:20 due to the inaccurate specific clock $F_{SPC}$. Thus, the processing module 320 updates the time value provided by the RTC 32 from 02:20 to 02:25.

Additionally, the counter 310 begins counting according to a correction timer 350 counting time according to the reference clock $F_{ref}$. Because the frequency of the reference clock $F_{ref}$ is 13 MHz, the correction timer 350 increases the accumulated count of the counter 310 by one unit every $$\frac{120}{26}\ \text{ms}.$$

When the correction timer 350 counts to time point $T_1$, the processing module 320 records the time value $TV_1$ and the index $ID_1$. When the correction timer 350 counts time to the time point $T_2$, the processing module 320 records the index $ID_2$ and then directs the RTC 32 to provide a correct time value according to the indexes $ID_1$ and $ID_2$.

The duration between time points $T_1$ and $T_2$ should be a fixed value but the processing module 320 does not immediately record the index $ID_2$ because a system comprising the device 300 is busy. Thus, the recording delay time is considered by the processing module 330.

Figure 4:
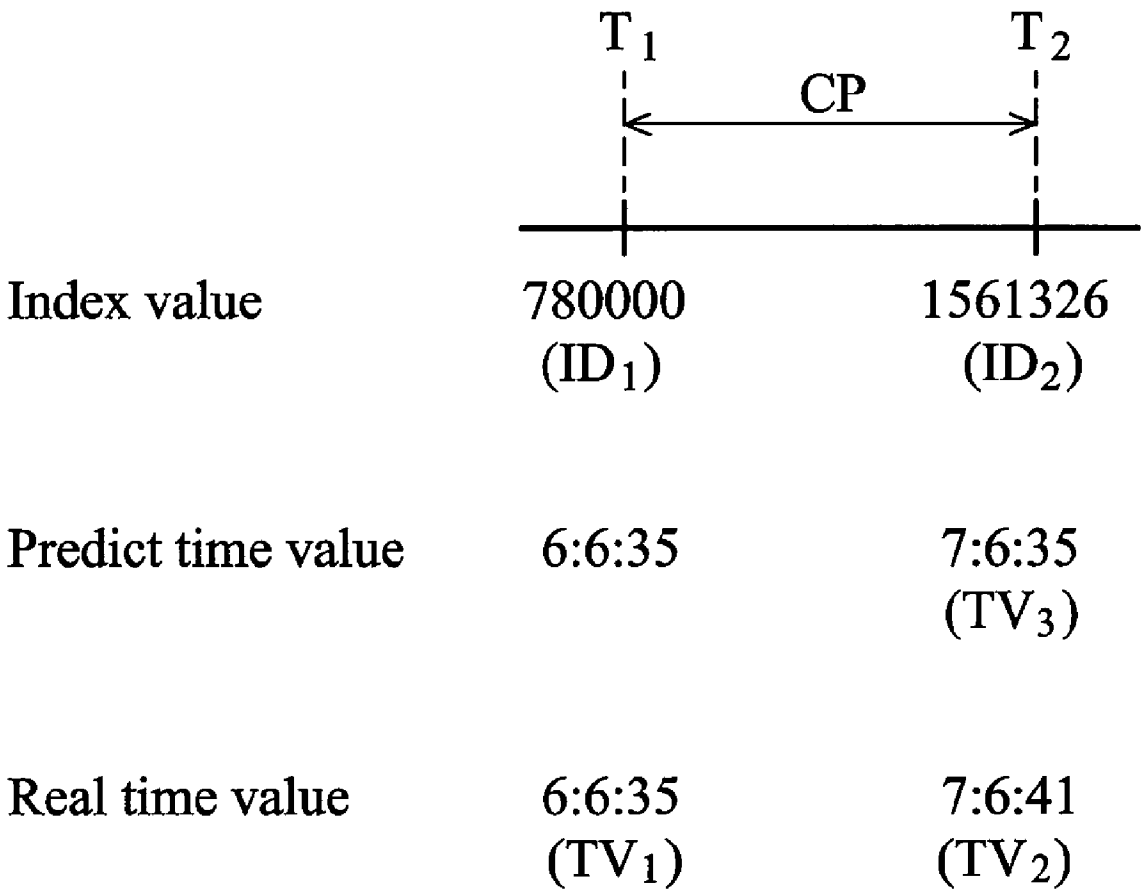
FIG. 4 is a schematic diagram of the calculating performed by the processing module.

FIG. 4 is a schematic diagram showing a calculation performed by the processing module. Assuming the counter 310 requires one hour to count 780000 times and the processing module 320 updates the time value of the RTC every hour.

At the time point $T_1$, the time value $TV_1$ recorded by the processing module 320 is 6:6:35 and the index $ID_1$ recorded by the processing module 320 is 780000. At the time point $T_2$, the index $ID_2$ recorded by the processing module 320 should be 1560000. The real index $ID_2$ is, however, 1561326 because the system is busy.

The processing module 320 calculates a difference $DIFF_1$ between indexes $ID_1$ and $ID_2$. The difference $DIFF_1$ is expressed by the following equation (1):

$$DIFF_1=ID_2-ID_1=1561326-780000=781326 \qquad \text{Equation (1)}$$

Next, the processing module 320 converts the difference $DIFF_1$ into a correction time value $CTV_1$. The correction time value $CTV_1$ is expressed by the following equation (2):

$$CTV_1 = 781326 \times \frac{120}{26}\ \text{ms} = 3600\ \text{sec} + 6\ \text{sec} + 0.12\ \text{sec} \qquad \text{Equation (2)}$$

The processing module 320 calculates the sum of the time value $TV_1$ and the correction time value $CTV_1$ to set the time value $TV_2$. Thus, the time value $TV_2$ is 7:6:41.

In some embodiments, at the time point $T_1$, the processing module 320 records the time value $TV_1$ and the index $ID_1$. At the time point $T_2$, the processing module 320 records the time value $TV_3$ and the index $ID_2$, calculates a difference between the indexes $ID_1$ and $ID_2$, and adjusts the time value $TV_3$ to reflect the difference, thus, the RTC 310 provides the time value $TV_2$.

For example, at the time point $T_1$, the time value $TV_1$ is 6:6:35 and the index $ID_1$ is 780000. At the time point $T_2$, the time value $TV_3$ is 7:6:35 and the index $ID_2$ is 1561326.

The processing module 320 calculates a difference $DIFF_2$ between the indexes $ID_1$ and $ID_2$. The difference $DIFF_2$ is expressed by the following equation (3):

$$DIFF_2=ID_2-ID_1=1561326-780000=781326 \qquad \text{Equation (3)}$$

Next, the processing module 320 obtains an adjustment time value ATV according to the difference $DIFF_2$. The adjustment time value ATV is expressed by the following equation (4):

$$ATV = (781326 - 780000) \times \frac{120}{26}\ \text{ms} = 6\ \text{sec} + 0.12\ \text{sec} \qquad \text{Equation (4)}$$

The processing module 320 adjusts the time value $TV_3$ according to the adjustment time value ATV. In some embodiments, the time value $TV_2$ is equal to the sum of the time value $TV_3$ and the adjustment time value ATV. Thus, the time value $TV_2$ is 7:6:41.

Additionally, since the counter 310 stops counting when in sleep mode, the device 300 further comprises a sleep module to ensure the counter 310 counting from a correct index, when the sleep mode transits to a normal mode. The sleep module 360 controls the counter 310 according to the duration of the sleep mode.

Before the device 300 enters the sleep mode, the sleep module 360 records the index $ID_4$ provided by the counter 310 and then transmits the duration of the sleep mode into a sleep index SID. When the device 300 leaves the sleep mode, the sleep module 360 updates a calculation result, that is the sum of the index $ID_4$ and the sleep index SID, to the counter 310. Thus, the counter 310 counts from the index $ID_5$. In this embodiment, the index $ID_5$ is equal to the sum of the index $ID_4$ and the sleep index SID.

For example, before the device 300 enters sleep mode, the index $ID_4$ provided by the counter 310 is 124 and the duration of the sleep mode is 3 sec. The sleep module 360 records the index $ID_4$ and transmits the duration of the sleep mode into a sleep index SID. The sleep index is expressed by the following equation (5):

$$SID = 3\ \text{sec} \times \frac{26}{120}\ \text{ks} = 650 \qquad \text{Equation (5)}$$

When the device 300 leaves the sleep mode, the index $ID_5$ is expressed by the following equation (6):

$$ID_5=ID_4+SID=124+650=774 \quad \text{Equation (6)}$$

Thus, when device 300 again enters the normal mode, the counter 310 starts to count form 774.

Figure 5:
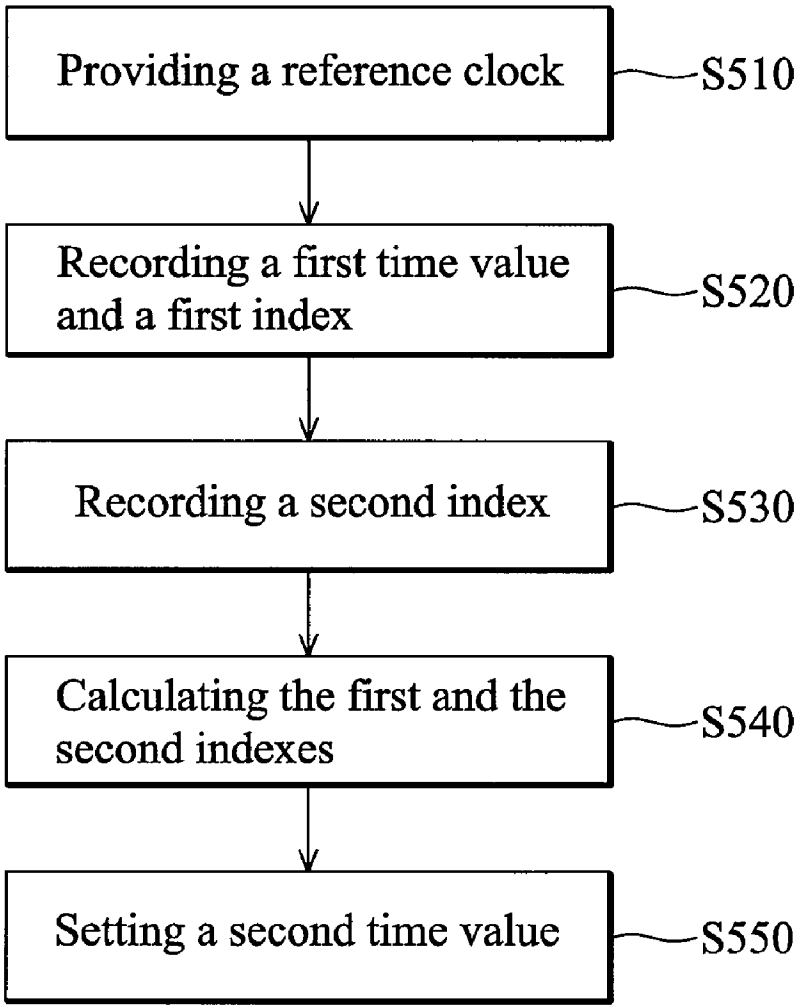
FIG. 5 is a flowchart of a method applied in a portable device.

FIG. 5 is a flowchart of a method. The method is applied in a portable device. A reference clock $F_{ref}$ is provided (step S510). Since the reference clock $F_{ref}$ may have a drift error, a system clock provided by a base station is utilized to correct the reference clock $F_{ref}$.

At a first time point, a first time value and a first index are recorded (step S520). Taking FIG. 3 as an example, the processing module 320 records the time value $TV_1$ provided by the RTC 32 and records the index $ID_1$ provided by the counter 310 at the time point $T_1$. In this embodiment, the RTC 32 provides a time value according to the specific clock $F_{SPC}$ generated by the frequency generator 340. The frequency of the reference clock $F_{ref}$ exceeds that of the specific clock $F_{SPC}$.

At a second time point, a second index is recorded (step S530). In this embodiment, the first time point and the second time point are counted according to the reference clock. Taking FIG. 3 as an example, the processing module 320 records the index $ID_2$ provided by the counter 310 at the time point $T_2$. In some embodiments, the processing module 320 further records the time value $TV_3$ provided by the RTC 32.

The first index and the second index are calculated (step S540). A second time value is set according to the calculating result (step S550). In this embodiment, the processing module 320 calculates a difference between the indexes $ID_1$ and $ID_2$ and transforms the difference into a correction time value. The sum of the time value $TV_1$ and the correction time value are calculated to obtain the second time value. In some embodiments, when a third time value is recorded, the processing module 320 adjusts the third time value for obtained the second time value according to a difference of the index values $ID_1$ and $ID_2$.

Additionally, in some embodiments, a correction timer is utilized. The correction timer counts time according to the reference clock. When the correction timer counts time to a first time point, the first time value and the first index are recorded. When the correction timer counts time to a second time point, the second index is recorded.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for a portable device, comprising:

providing a reference clock;

recording a first time value and a first index at a first time point;

recording a second index at a second time point, wherein the first time point and the second time point are counted according to the reference clock;

calculating the first index and the second index;

setting a second time value according to the calculating result, wherein the calculating step comprises:

calculating the difference between the first index and the second index;

converting the difference into a correct time value according to the reference clock; and adding up the first time value and the correct time value.

2. The method as claimed in claim 1, wherein the calculating step comprises calculating the difference between the first index and the second index.

3. The method as claimed in claim 2, wherein the second time value is set in light of the difference.

4. The method as claimed in claim 2, further comprising:

recording a third time value at the second time point; and adjusting the third time value in light of the difference for setting the second time value.

5. The method as claimed in claim 1, wherein a system clock corrects the reference clock.

6. The method as claimed in claim 5, wherein a base station provides the system clock.

7. The method as claimed in claim 1, wherein a correction timer for implementing the recording steps is turned on, the correction timer counting time according to the reference clock.

8. The method as claimed in claim 7, wherein the first time value and the first index are recorded when the correction timer counts time to the first time point and the second index is recorded when the correction timer counts time to the second time point.

9. The method as claimed in claim l, wherein the second time value is equal to the sum of the first time value and the correct time value.

10. The method as claimed in claim 1, wherein the first time value is provided by a specific clock.

11. The method as claimed in claim 10, wherein the frequency of the reference clock exceeds that of the specific clock.

12. An apparatus for a portable device, comprising:

a counter counting and providing a first index and a second index according to a reference clock, wherein the counter stops counting in a sleep mode and counts continuously in a normal mode;

a processing module recording a first time value provided by a real time clock and the first index at a first time point and the second index at a second time point and calculating the first and second indexes such that the real time clock provides a second time value, wherein the first time point and the second time point are counted according to the reference clock; and a sleep module for controlling the counter according to the sleep mode duration, wherein the counter provides a fourth index in the sleep mode and provides a fifth index in the normal mode, and the sleep module converts the sleep mode duration into a sleep index and adds up the fourth index and the sleep index such that the counter provides the fifth index in the normal mode.

13. The apparatus as claimed in claim 12, further comprising a first frequency generator to provide the reference clock.

14. The apparatus as claimed in claim 13, wherein the first frequency generator is a crystal.

15. The apparatus as claimed in claim 12, further comprising a second frequency generator to provide a specific clock.

16. The apparatus as claimed in claim 15, wherein the real time clock provides the first time value according to the specific clock.

17. The apparatus as claimed in claim 16, wherein the frequency of the reference clock exceeds that of the specific clock.

18. The apparatus as claimed in claim 12, wherein the reference clock is corrected by a system clock.

19. The apparatus as claimed in claim 18, wherein the system clock is provided by a base station.

20. The apparatus as claimed in claim 12, further comprising a correction timer counting time according to the reference clock.

21. The apparatus as claimed in claim 20, wherein the processing module records the first time value and the first index when the correction timer counts time to the first time point and records the second index when the correction timer counts time to the second time point.

22. The apparatus as claimed in claim 12, wherein the processing module calculates the difference between the first and the second indexes and the real time clock provides the second time value according to the difference.

23. The apparatus as claimed in claim 12, wherein the processing module calculates the difference between the first and the second indexes, records a third time value at the second time point and adjusts the third time value according to the difference for setting the second time value.

24. The apparatus as claimed in claim 12, wherein the processing module calculates the difference between the first and the second indexes, converts the difference into a correct time value according to the reference clock, and calculates the sum of the first time value and the correct time value to set the second time value.

25. The apparatus as claimed in claim 12, wherein the sum of the fourth index and the sleep index is equal to the fifth index.

26. The apparatus as claimed in claim 12, wherein the counter is utilized for debugging.

27. The apparatus as claimed in claim 12, wherein the portable device is a mobile phone.

* * * * *